US010961469B2

(12) United States Patent
Coppola et al.

(10) Patent No.: US 10,961,469 B2
(45) **Date of Patent: *Mar. 30, 2021**

(54) HIGH EFFICIENCY POUR POINT REDUCTION PROCESS

(71) Applicant: Applied Research Associates, Inc., Albuquerque, NM (US)

(72) Inventors: Edward N. Coppola, Panama City, FL (US); Sanjay Nana, Panama City, FL (US); Charles Red, Jr., Youngstown, FL (US)

(73) Assignee: Applied Research Associates, Inc., Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/595,968

(22) Filed: Jan. 13, 2015

(65) Prior Publication Data

US 2015/0203768 A1 Jul. 23, 2015

Related U.S. Application Data

(60) Provisional application No. 61/929,341, filed on Jan. 20, 2014.

(51) Int. Cl.
*C10G 55/04* (2006.01)

(52) U.S. Cl.
CPC ..... *C10G 55/04* (2013.01); *C10G 2300/1022* (2013.01); *C10G 2300/304* (2013.01)

(58) Field of Classification Search
CPC .... C10G 1/045; C10G 9/00; C10G 2300/304; C10G 2300/1022; C10G 2300/1085
See application file for complete search history.

(56) References Cited

U.S. PATENT DOCUMENTS 3,136,711 A 6/1964 Glaser et al.
4,135,982 A * 1/1979 Green ..... C10B 49/16 208/401

(Continued)

FOREIGN PATENT DOCUMENTS

JP 5975985 A 4/1984
JP 2002155286 5/2002

(Continued)

OTHER PUBLICATIONS

Engineers Edge, "Large Steam System Condensers", Dec. 23, 2013, available at http://www.engineersedge.com/heat_exchanger/large_steam_condenser.htm (Continued)

*Primary Examiner* — Michelle Stein
(74) *Attorney, Agent, or Firm* — The Webb Law Firm

(57) ABSTRACT

A process and system for converting a high-pour-point organic feedstock to an upgraded product that exhibits good low-temperature properties (cloud point, pour point, and viscosity) and improved transportability. The high-efficiency process includes a continuous-flow, high-rate hydrothermal reactor system and integrated separation systems that result in low complexity, small footprint, high energy efficiency, and high yields of high-quality upgraded product. The system is specifically desirable for use in converting waxy feedstocks, such as yellow and black wax petroleum crudes and wax from the Fischer-Tropsch (FT) process, into upgraded crude that exhibits a high diesel fraction and, correspondingly, low vacuum gas oil (VGO) fraction.

25 Claims, 4 Drawing Sheets

(56) References Cited

U.S. PATENT DOCUMENTS

| | | | | |
|---|---|---|---|---|
| 4,454,023 | A | 6/1984 | Lutz | |
| 4,501,653 | A * | 2/1985 | Hamner | C10G 45/64 208/15 |
| 4,536,283 | A * | 8/1985 | Davis | C10C 3/08 208/309 |
| 7,399,408 | B2 | 7/2008 | Joussot-Dubien et al. | |
| 7,691,159 | B2 | 4/2010 | Li | |
| 7,727,376 | B2 | 6/2010 | Adams et al. | |
| 7,740,065 | B2 | 6/2010 | Choi | |
| 8,815,081 | B2 | 8/2014 | Choi | |
| 10,010,839 | B2 | 7/2018 | Choi et al. | |
| 2005/0131082 | A1 * | 6/2005 | Henderson | C10G 2/32 518/726 |
| 2006/0016722 | A1 * | 1/2006 | Espinoza | C10G 2/32 208/14 |
| 2007/0056879 | A1 | 3/2007 | Euzen et al. | |
| 2007/0056881 | A1 * | 3/2007 | Berkowitz | C10G 1/047 208/435 |
| 2008/0099374 | A1 * | 5/2008 | He | B01J 3/008 208/177 |
| 2009/0145805 | A1 * | 6/2009 | Choi | C10G 9/00 208/106 |
| 2009/0159498 | A1 * | 6/2009 | Chinn | C10G 9/00 208/85 |
| 2009/0166261 | A1 | 7/2009 | Li et al. | |
| 2009/0206006 | A1 * | 8/2009 | Allam | B01F 5/0604 208/107 |
| 2010/0294696 | A1 | 11/2010 | Tanaka et al. | |
| 2010/0300933 | A1 | 12/2010 | Tanaka | |
| 2012/0181217 | A1 | 7/2012 | Choi et al. | |
| 2013/0112594 | A1 | 5/2013 | Shih et al. | |
| 2013/0206645 | A1 * | 8/2013 | Yarbro | C10G 31/08 208/106 |
| 2013/0292299 | A1 | 11/2013 | Koseoglu et al. | |
| 2013/0310613 | A1 | 11/2013 | Kalnes | |
| 2013/0313162 | A1 | 11/2013 | Choi et al. | |
| 2014/0109465 | A1 | 4/2014 | Coppola et al. | |

FOREIGN PATENT DOCUMENTS

| | | | |
|---|---|---|---|
| JP | 2008506023 | A | 2/2008 |
| JP | 2009513496 | A | 4/2009 |
| JP | 2011504962 | A | 2/2011 |
| WO | 2009073446 | A2 | 6/2009 |

OTHER PUBLICATIONS

Wikipedia, "Flash Evaporation", Dec. 16, 2013, available at http://en.wikipedia.org/wiki/Flash_evaporation.

* cited by examiner

HIGH EFFICIENCY POUR POINT REDUCTION PROCESS

CROSS-REFERENCE TO RELATED APPLICATIONS

This application claims priority to U.S. Provisional Patent Application No. 61/929,341, filed Jan. 20, 2014, the entire content of which is incorporated herein by reference.

FIELD OF THE INVENTION

The present invention is directed to a high-efficiency process and system for converting high-pour-point, high-melting-point petroleum or synthetic organic feedstocks into upgraded crude or fuel products that exhibit good low-temperature properties (cloud point, pour point, and viscosity) and improved transportability. The high-efficiency process includes a high-rate hydrothermal reactor system and integrated separation systems that result in low complexity, small footprint, high energy efficiency, and high yields of high-quality upgraded product. The system is specifically useful in converting waxy feedstocks, such as yellow and black wax petroleum crudes and wax from the Fischer-Tropsch (FT) process, into upgraded crude that includes a high diesel fraction and a correspondingly low vacuum gas oil (VGO) fraction.

BACKGROUND OF THE INVENTION

Yellow wax and black wax petroleum crude oils exhibit high-pour-points (greater than 110° F.) and are semi-solid at ambient temperatures. While there are large waxy crude resources in the state of Utah, waxy crudes are produced in other regions of the United States and throughout the world. Waxy crude oils present severe transportation and logistics problems. Waxy crude oils can only be transported via insulated tank trucks to locations within a few hours of the oil field. Transportation to markets outside the local area requires heated trucks or rail cars, or heated pipelines. Heated waxy crude oils present a safety problem since they exhibit flash points close to their pour point. In Utah, waxy crudes are transported by insulated trucks to local refineries. This creates logistics, safety, and health issues due to the large volume of trucks required to travel over mountainous terrain, by secondary roads, near drinking water reservoirs, and through populated areas.

Solutions to transportation problems have focused mostly on the use of additives to reduce the pour point. However, these approaches have not been able to reduce the pour point sufficiently to permit use of conventional, unheated, transportation systems, such as tank truck, rail, pipeline, and the like. Dilution with other crude oils is another potential solution, but acceptable concentrations of waxy crude oils are very low, which creates logistic, production, and economic issues.

Refining waxy crudes present additional challenges and require changes in current refinery operations and equipment. A waxy crude usually consists of a variety of light and intermediate hydrocarbons and wax, which primarily consists of paraffin hydrocarbons (C18-C50+), known as paraffin wax, and a variety of other heavy organic compounds that include resins and asphaltenes. As used herein, hydrocarbon molecules may be defined by the number of carbon atoms. For example, any hydrocarbon molecule having eighteen carbon atoms is termed as a C18 and a hydrocarbon molecule having 50 carbon atoms is termed as a C50. Even though waxy crudes typically exhibit high API gravities, characteristics of light crude oils, the fraction of crude that boils higher than diesel, i.e., the fraction that distills at an atmospheric equivalent temperature (AET) greater than 650° F., is much greater than typical crude oils that exhibit much lower API gravity. The fraction that boils at 650° F. to 1000° F. is defined as vacuum gas oil (VGO) and the fraction that boils at greater than 1000° F. is defined as residuum (resid). The VGO fraction of waxy crude oils is typically greater than 60% of the crude. This presents a problem for conventional refineries designed to process crude oil that may only contain 30-40% VGO and resid. In conventional petroleum refining, the VGO fraction is the overhead fraction from a vacuum distillation tower. The VGO fraction may be cracked into distillate fuels (<650° F.) using conventional hydrocracking or Fluid Catalytic Cracking (FCC) technology. As used herein, reference to a fraction by a temperature value or range. (such as "<650° F.") means that fraction boils at that temperature or range. However, the high VGO content of waxy crudes creates a severe bottleneck in the typical petroleum refinery. The conventional solution to this bottleneck is the addition of very expensive vacuum distillation and hydrocracking or FCC systems.

Due to the logistic, safety, and refining issues associated with waxy petroleum crude oils, the value of these crudes is depressed by as much as 20% relative to other benchmark crude oils, such as West Texas Intermediate (WTI). Large deposits of waxy crude oils are not considered "proven reserves" because they are not recoverable with existing equipment and under the existing conditions. If waxy crude oils could be upgraded to allow transportation by unheated trucks, railcars, and pipelines, and the VGO content was reduced to permit maximum throughput in typical refineries without modification, the value of these crude oils would exceed the value of WTI. In addition, as "proven reserves," financing for additional waxy crude production infrastructure would then become readily available.

In addition to waxy crude oils, other materials exhibit similar transportation problems. Heavy oils and bitumen-type materials exhibit high viscosities and must be processed near the field to reduce viscosity or be diluted with a light crude oil or naphtha to permit transportation by pipeline. Synthetic hydrocarbons, such as wax produced by the Fischer-Tropsch (FT) process, exhibit even higher melting and pour points than waxy crude oils. Wellhead gas and stranded gas represent problems to oil and gas production that can be addressed by conversion into FT wax in the field. However, the transportation of solid wax is cost prohibitive due to logistic and refining issues. The ability to convert FT wax into liquid hydrocarbons in the field would greatly improve the logistics, economics, and technical viability of FT wax production and conversion.

SUMMARY OF THE INVENTION

The present invention is a process and system that uses a continuous-flow, high-rate, hydrothermal reactor for converting high-pour-point and high viscosity organic feedstocks, such as waxy crudes or FT wax, into upgraded or synthetic crude oils (syncrude) that exhibit reduced pour point and viscosity. Hydrothermal pour point reduction upgrades hydrocarbon feedstocks in a process that combines high-temperature, supercritical water with the organic feedstock at conditions that result in rapid cracking of paraffinic molecules while minimizing the formation of coke and gas. The residence time in the high-rate hydrothermal reactor is less than 1 minute. In the case of a feedstock like yellow wax crude oil, the upgraded product exhibits a pour point reduction from 43.3° C. (110° F.) to less than 0° C. (32° F.) and VGO fraction reduction from 60% to 15%. In addition, diesel fuel fractions up to 65% may be realized.

This invention takes advantage of the energy in the hydrothermal reactor product stream to perform atmospheric-pressure separation of process streams and achieve high thermal efficiency by integration of heat generation, reaction, and recovery processes. The small amount of byproduct gas generated during upgrading is sufficient to provide all the heat requirements for the process. The API gravity of the product is higher than the feedstock, which results in high volumetric yields from 95 to 100%. No byproducts or organic waste products are generated for some embodiments of the invention and over 90% of the processed water may be recycled.

This invention has numerous advantages over other hydrothermal upgrading processes, conventional refinery upgrading processes, or other methods that include dilution and/or the use of additives. A summary of the advantages for waxy crude upgrading include, but are not limited to: 1) hydrothermal cracking of paraffinic feedstocks without the need for hydrogen, vacuum distillation, hydrocracking, or fluid catalytic cracking (FCC) unit operations; 2) very short residence time (>1 minute) resulting in very small process equipment that can be co-located with a conventional refinery or implemented near oil fields; 3) low capital cost resulting from small equipment and system footprint, no catalyst requirement, and no hydrogen generation equipment; 4) low operating cost resulting from no additional energy requirement for process heat, no catalyst replacement cost, no additive requirement, minimal waste and byproduct generation, and minimal water use and treatment costs; 5) use of high-energy process streams containing water for product separation which eliminates the need for conventional vacuum distillation; and 6) production of high yields of upgraded crude with a pour point below 32° F., viscosity below 5 centistokes (cSt) @ 40° C. (104° F.), VGO fraction less than 15%, and high diesel fuel yield.

Waxy crude oils and whole FT wax products contain naphtha and diesel fractions that do not require upgrading. The distillate fraction may be separated by conventional distillation to reduce the amount of crude that requires processing. In an alternative approach, in accordance with the present invention, the high-energy reactor effluent stream may be used to strip the distillate fraction of the virgin feedstock in a separation system to cause a lighter, distillate fraction of the feedstock to be separated from the heavier fraction along with upgraded crude distillate. The heavier fraction (>650° F.) of the crude feedstock and unconverted product may then be further upgraded into distillate in the high-rate, hydrothermal reactor system. Separation systems may include one or more flash drums, one or more distillation or rectifying columns, one or more condensers, and one or more oil-water separators. The energy provided by the product stream is sufficient to permit low pressure operation of the separation systems and negate the need for vacuum distillation.

Some crude oils contain significant levels of asphaltenes or exhibit a high Conradson Carbon Residue (CCR). The industry standard for processing of VGO-type material has a CCR value of approximately 0.5%. Accordingly, crude oils that exhibit a high CCR would be greater than 0.5% and crude oils that exhibit a low CCR would be less than about 0.5%. These oils may require separation of the residuum fraction to improve processability. According to another embodiment of this invention, the heavy fraction (>650° F.) of the feedstock may be subjected to deasphalting processes to remove the asphaltenes before being upgraded in the high-rate hydrothermal reactor. An alternative approach is to employ vacuum distillation of the heavy fraction to remove asphaltenes in the bottoms (asphalt) fraction and provide a VGO-equivalent intermediate product for further upgrading.

In accordance with the present invention, a continuous flow process for converting a high-pour-point organic feedstock to an upgraded product comprises providing a high-pour-point organic feedstock, feeding the high-pour-point organic feedstock into a separation system to produce a distillate fraction and a heavy fraction, feeding the heavy fraction from the separation system into a high rate hydrothermal reactor system to produce an upgraded heavy fraction, and feeding the upgraded heavy fraction into the separation system or combining the upgraded heavy fraction with the distillate fraction to form the upgraded product.

When the upgraded heavy fraction can be fed into the separation system, the high rate hydrothermal reactor system is capable of transferring a predetermined amount of energy to the heavy fraction such that when the upgraded heavy fraction is fed into the separation system, the predetermined amount of energy is sufficient to effect separation of the distillate fraction and the heavy fraction.

The process further includes mixing the heavy fraction from the separation system with one of a water and water-oil mixture to produce a heavy fraction mixture and feeding the heavy fraction mixture into the high rate hydrothermal reactor system. The process also includes providing one or more separators associated with the distillate fraction or the upgraded heavy fraction for recovering water for recycling and combining with the heavy fraction.

The process also includes maintaining a temperature and pressure of the water and heavy fraction mixture in the high-rate reactor system for sufficient time to produce an upgraded heavy fraction that has a low-pour-point.

The high-pour-point organic feedstock can be any feedstock that exhibits pour points greater than 10° C. (50° F.) and is selected from the group consisting of heavy crude oil, tar sands bitumen, shale oil, waxy crude oils including yellow wax and black wax, petroleum oil fractions, synthetic crudes, such as wax from a Fischer-Tropsch (FT) process, and mixtures thereof.

The separation system can be operated at net positive pressure of 2 psig to 30 psig and can comprise at least one of one or more flash drums, one or more rectification columns, one or more distillation columns, or any combination thereof.

The process can further include depressurizing the upgraded heavy fraction exiting from the high-rate hydrothermal reactor system, filtering the depressurized upgraded heavy fraction, partially cooling the filtered depressurized heavy fraction in a feed-effluent heat exchanger, and feeding the partially cooled heavy fraction to a flash drum where a bottoms portion that contains refractory compounds is combined with the distillate fraction from the separation system to form the upgraded product.

The process can also include providing one or more condensers to condense the distillate fraction from the separation system to produce fuel gas and a reflux stream, wherein a first portion of the reflux stream is fed into the separation system and a second portion of the reflux stream is combined with a portion of the upgraded heavy fraction from the high-rate hydrothermal reactor to produce the upgraded product without any liquid byproducts.

The process can also include a step of treating the heavy fraction exiting from the separation system to a deasphalting process to remove coke precursors from feedstocks exhibiting high Conradson Carbon Residue (CCR) before the heavy fraction is fed to the high-rate reactor system. It can be appreciated that the deasphalting process can be any known process, such as a solvent deasphalting process, vacuum distillation, and the like.

According to one aspect of the invention, the water-to-oil weight ratio in the high-rate hydrothermal reactor system can be between 1:20 and 1:1 or even between 1:10 and 1:2. The heavy fraction and oil-water mixture can be heated in the high-rate hydrothermal reactor system to a temperature between 400° C. (752° F.) and 600° C. (1112° F.) or even to a temperature between 450° C. (842° F.) and 550° C. (1022° F.). Additionally, the pressure in the high-rate hydrothermal reactor system can be maintained between 1500 psig and 6000 psig or even between 3000 psig and 4000 psig. Also, the high-rate hydrothermal reactor system residence time at operating conditions can be less than 1 minute.

When the upgraded heavy fraction is combined with the distillate fraction to form the upgraded product, the process can further include depressurizing the upgraded heavy fraction exiting the high-rate hydrothermal reactor system, filtering the depressurized upgraded heavy fraction, feeding the filtered upgraded heavy fraction to a feed-effluent heat exchanger, cooling the filter upgraded heavy fraction, feeding the cooled upgraded heavy fraction to one or more separators to remove fuel gas and water therefrom, and combining the upgraded heavy fraction exiting the one or more separators with the distillate fraction to form the upgraded product without the production of liquid byproducts. This process can also include the step of treating the heavy fraction from the separation system in a deasphalting process to remove coke precursors from feedstocks exhibiting high CCR before the heavy fraction is fed to the high-rate reactor system and wherein the deasphalting process comprises a known deasphalting process, such as solvent deasphalting process, vacuum distillation, and the like.

In accordance with another aspect of the invention, a continuous flow system for converting a high-pour-point organic feedstock to an upgraded product comprises a high-pour-point organic feedstock, a separation system for receiving the high-pour-point product and for separating the high pour point product into a distillate fraction and a heavy fraction, and a high rate hydrothermal reactor system for receiving the heavy fraction from the separation system and to upgrade the heavy fraction into an upgraded heavy fraction, wherein the upgraded heavy fraction can be fed into the separation system or can be combined with the distillate fraction to form the upgraded product. The high-rate hydrothermal reactor system is configured to operate at a temperature and pressure so as to transfer a predetermined amount of energy to the heavy fraction such that when the upgraded heavy product is fed into the separation system, the predetermined amount of energy is sufficient to effect separation of the distillate fraction and the heavy fraction. The system can further include a water or water-oil mixture feed for mixing with the heavy fraction from the separation system at a location in line before the high rate hydrothermal reactor system. The high-pour-point organic feedstock has a pour point greater than 10° C. (50° F.) and is selected from the group consisting of heavy crude oil, tar sands bitumen, shale oil, waxy crude oils including yellow wax and black wax, petroleum oil fractions, synthetic crudes, and mixtures thereof.

The system can further comprise a depressurizing device for depressurizing the upgraded heavy fraction exiting from the high-rate hydrothermal reactor system, a filter for filtering the depressurized upgraded heavy fraction, a feed-effluent heat exchanger for partially cooling the filtered depressurized heavy fraction, and a flash drum for receiving the partially cooled heavy fraction where a bottoms portion that contains refractory compounds is combined with the distillate fraction from the separation system to form the upgraded product. The system can also include one or more condensers to condense the distillate fraction from the separation system to produce fuel gas and a reflux stream, wherein a first portion of the reflux stream is fed into the separation system and a second portion of the reflux stream is combined with a portion of the upgraded heavy fraction from the high-rate hydrothermal reactor to produce the upgraded product without producing any liquid byproducts.

The system can further comprise a deasphalting device for treating the heavy fraction exiting from the separation system to remove coke precursors from feedstocks exhibiting high CCR before the heavy fraction is fed to the high-rate reactor system.

The system can further comprise a depressurizing device for depressurizing the upgraded heavy fraction exiting the high-rate hydrothermal reactor system, a filter for filtering the depressurized upgraded heavy fraction, a feed-effluent heat exchanger for cooling the filtered upgraded heavy fraction, one or more separators for separating fuel gas and water from the upgraded heavy fraction, wherein the upgraded heavy fraction exiting the one or more separators is combined with the distillate fraction to form the upgraded product without the production of liquid byproducts. The deasphalting device can comprise a solvent deasphalting device, a vacuum distillation device, and the like.

DESCRIPTION OF THE INVENTION

Figure 1:
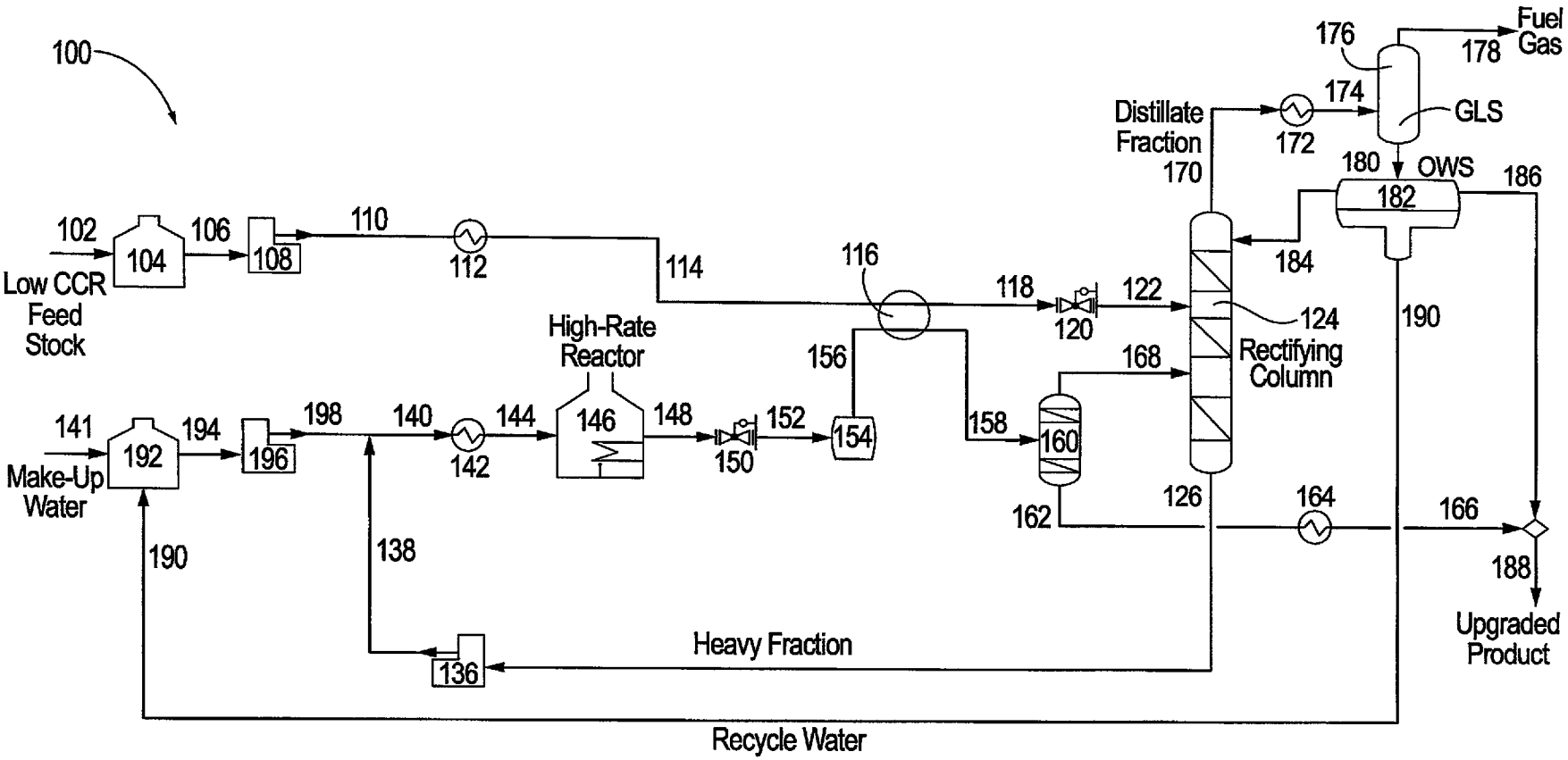
FIG. 1 is a schematic view of the pour point reduction process in accordance with the present invention that uses the high-energy reactor product to split the product and low-CCR feedstock in a rectifying column into distillate and heavy fractions and the heavy fraction is fed directly into the high-rate hydrothermal reactor system.

As used herein, unless otherwise expressly specified, all numbers such as those expressing values, ranges, amounts, or percentages may be read as if prefaced by the work "about", even if the term does not expressly appear. Any numerical range recited herein is intended to include all sub-ranges subsumed therein. Plural encompasses singular and vice versa. For example, while the invention has been described in terms of "a" polyester stabilizer, "an" ethylenically unsaturated monomer, "an" organic solvent, and the like, mixtures of these and other components, including mixtures of microparticles, can be used. When ranges are given, any endpoints of those ranges and/or numbers within those ranges can be combined with the scope of the present invention. "Including", "such as", "for example" and like terms mean "including/such as/for example but not limited to".

For purposes of the description hereinafter, the terms "upper", "lower", "right", "left", "vertical", "horizontal", "top", "bottom", "lateral", "longitudinal", and derivatives thereof, shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

It should be understood that any numerical range recited herein is intended to include all sub-ranges subsumed therein. For example, a range of "1 to 10" is intended to include any and all sub-ranges between and including the recited minimum value of 1 and the recited maximum value of 10, that is, all sub-ranges beginning with a minimum value equal to or greater than 1 and ending with a maximum value equal to or less than 10, and all sub-ranges in between, e.g., 1 to 6.3, or 5.5 to 10, or 2.7 to 6.1.

The present invention is directed to an improved feedstock upgrading process and system that is especially useful for upgrading high-pour-point (typically greater than 10° C. or 50° F. or even feeds having pour points of more than 110° F.) high viscosity feedstocks, such as waxy crudes, Fischer-Tropsch (FT) wax, heavy crude oil, or bitumen into an upgraded product having a lower viscosity and lower pour point in which the product can be transported in unheated trucks, rail cars, and pipelines. The present invention can also be used to convert other feedstocks including shale oil, petroleum oil fractions, synthetic crudes, and mixtures thereof. The process and system results in significantly increased yield of distillate (<650° F. or >353° C.) and reduced VGO and residuum content (>650° F. or >343° C.). The system relies on a high-rate hydrothermal reactor system that selectively cracks high molecular weight paraffin waxes in supercritical water to minimize coke and gas formation. Energy from the reactor effluent is employed to separate the distillate fraction of the feedstock and reactor effluent from unreacted and virgin heavy fraction that is further upgraded in the high-rate hydrothermal reactor system. Operation in this manner results in high energy efficiency, conversion at relatively mild conditions, high product yields, and a smaller high-rate reactor system since it is designed to treat only a fraction of the virgin feedstock. Other advantages of processing only the heavy fraction of the high-pour-point feedstock include reduction in the size of high-pressure equipment, reduction in the size of deasphalting equipment (if required), elimination of the need for vacuum distillation, low energy consumption, low fuel gas and waste generation, and improved oil/water separation, which permits maximum water recovery and reuse.

Reference is now made to FIG. 1, wherein virgin high-pour-point feedstock that exhibits a low Conradson Carbon Residue (CCR) (i.e., less than 0.5%) is combined directly with upgraded bottoms effluent from the high-rate hydrothermal reactor system in a separation system or rectifying column. In this embodiment, energy from reactor effluent is transferred directly to the virgin feedstock to vaporize the distillate fraction and cool the reactor effluent to condense the heavy fraction. The distillate fraction of the virgin feedstock and the distillate fraction of the upgraded heavy fraction are recovered in the overhead stream. The heavy fraction (>650° F. or >343° C.) of the virgin feedstock and the heavy fraction remaining after conversion in the high-rate hydrothermal reactor system are recovered in the bottom stream. Since the uncracked heavy fraction is recycled to the high-rate reactor, a mechanism is provided to remove a small slipstream of the heavy fraction refractory compounds to prevent buildup of these compounds in the process. The slipstream is combined with the distillate fraction to form the upgraded product. Benefits of the direct contact approach include: 1) direct heat transfer in the separation system and corresponding reduction in heat exchanger requirements; 2) recycle of uncracked high molecular weight paraffin waxes to the high-rate hydrothermal reactor; 3) less severe operating conditions as a result of recycling uncracked product; and 4) high distillate yield and low gas and VGO yield.

Figure 3:
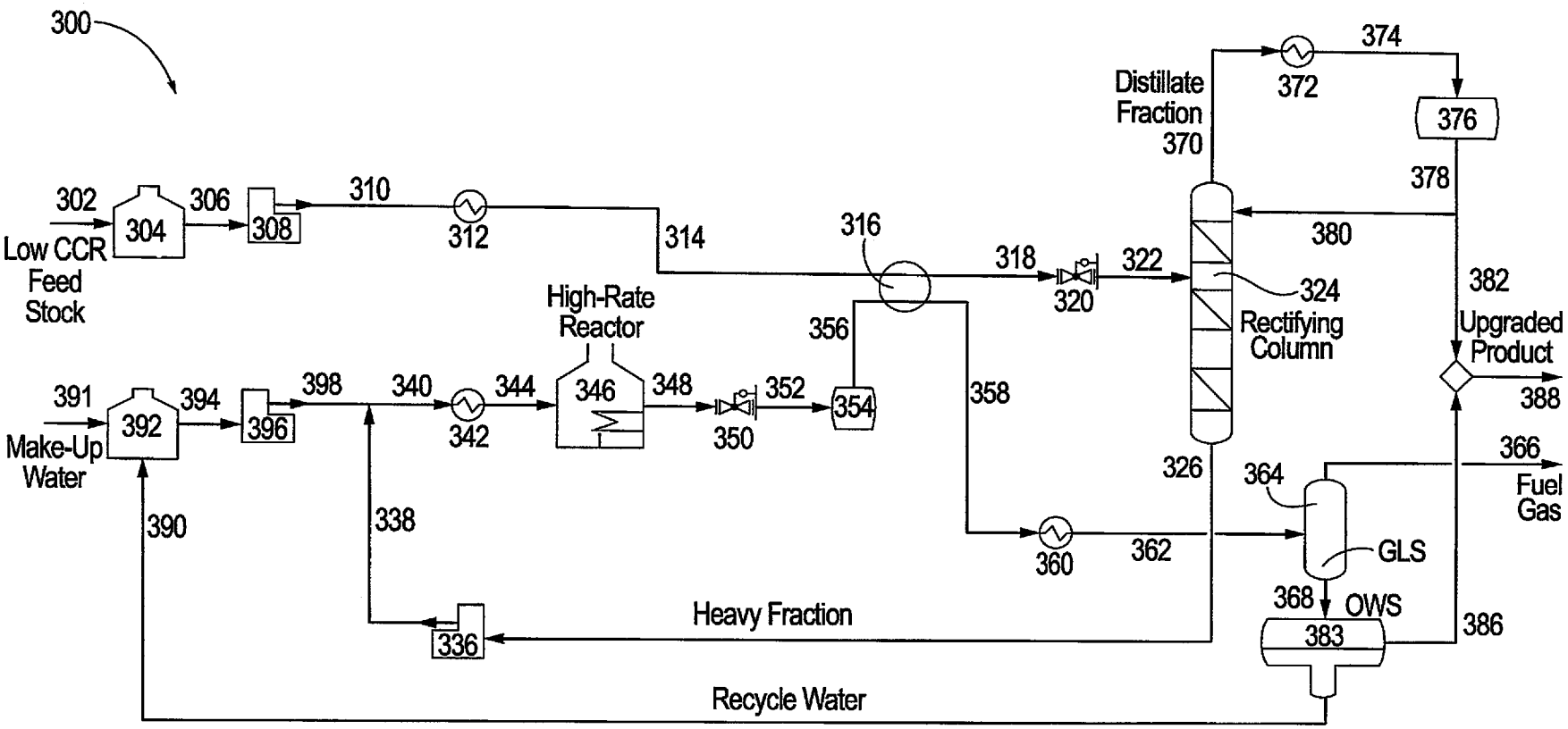
FIG. 3 is a schematic view of the pour point reduction system in accordance with the present invention where the low-CCR feedstock is distilled into distillate and heavy fractions and only the heavy fraction of the feedstock is upgraded in the high-rate hydrothermal reactor system.

In FIG. 3, only the low CCR virgin feedstock is split in the rectifying column into a distillate fraction and heavy fraction that is then fed directly to the high-rate hydrothermal reactor system. The feedstock is heated indirectly by heat exchange with other process streams. High-rate hydrothermal reactor effluent is cooled, separated from fuel gas and water, and combined in its entirety with the distillate fraction to form an upgraded product. Benefits of the indirect contact approach include: 1) smaller high-rate reactor and separation systems; 2) simplified design and operation; and 3) low bromine number of the heavy fraction that will reduce the rate of coke formation in the high-rate reactor system.

Figure 2:
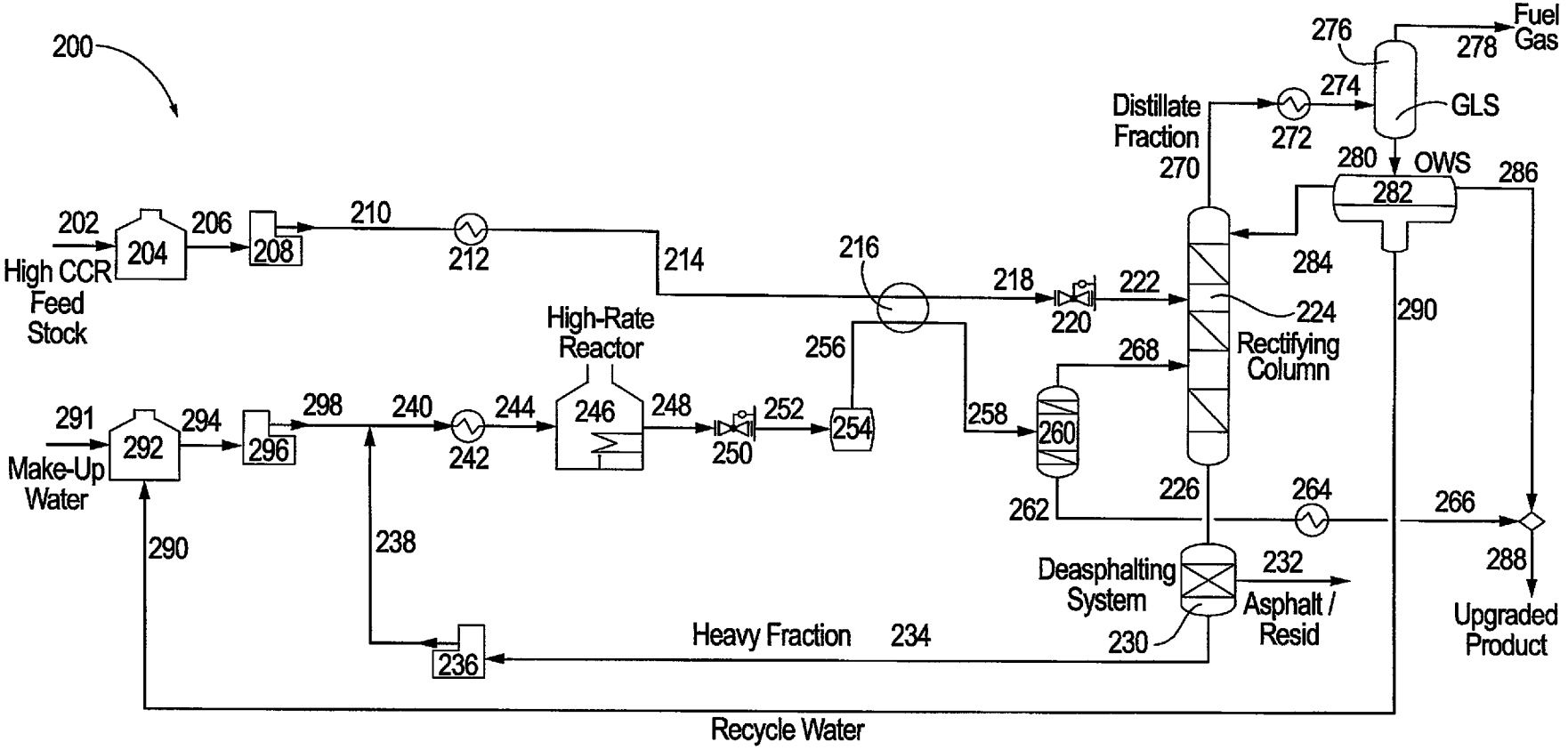
FIG. 2 is a schematic view of the pour point reduction process in accordance with the present invention for high-CCR feedstock that is similar to FIG. 1; however, the heavy fraction from the rectifying column undergoes deasphalting before processing in the high-rate hydrothermal reactor system.
Figure 4:
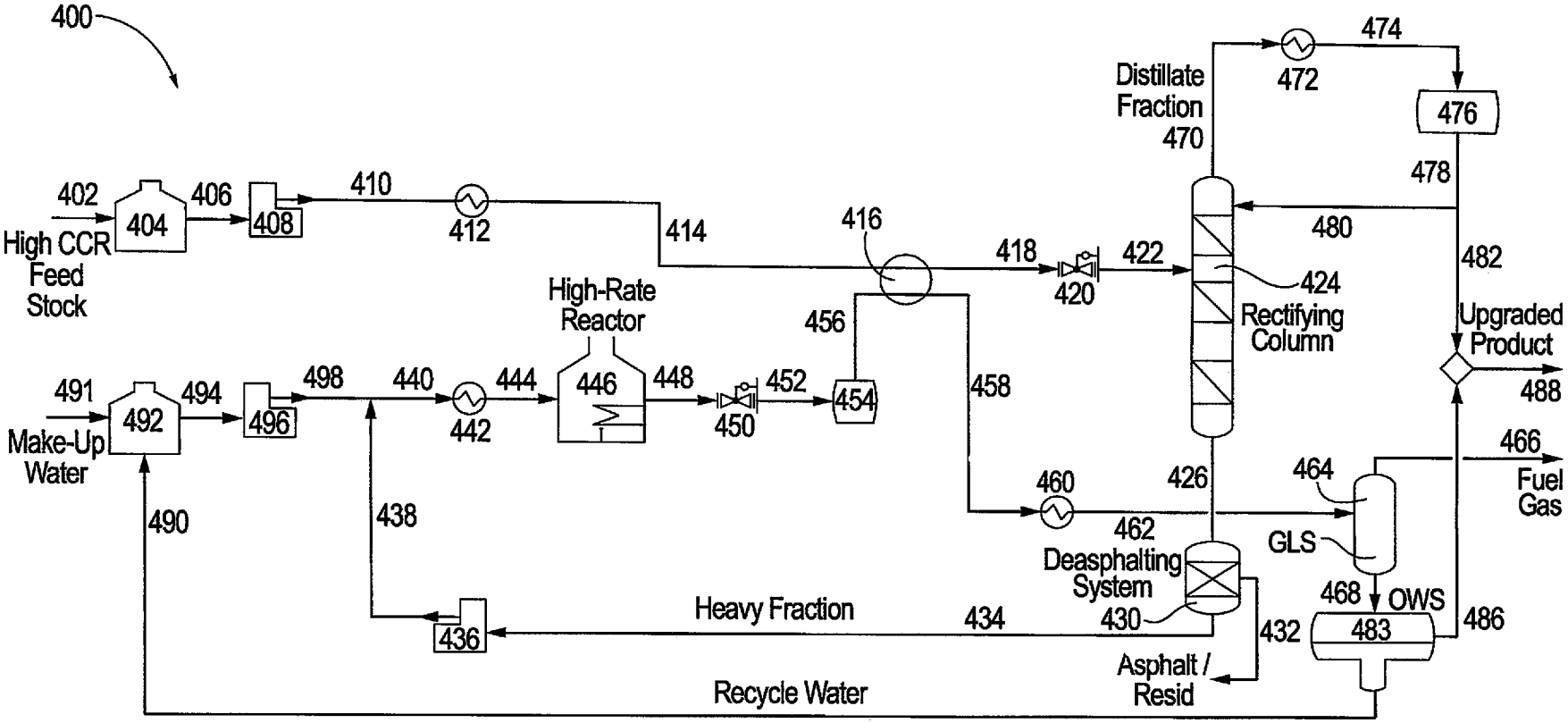
FIG. 4 is a schematic view of the pour point reduction system in accordance with the present invention for high-CCR feedstocks that is similar to FIG. 3; however, the heavy fraction of the feedstock undergoes deasphalting before being upgraded in the high-rate hydrothermal reactor system.

FIGS. 2 and 4 are directed to feedstocks that exhibit a high CCR (i.e., greater than 0.5%). CCR provides an indication of the relative coke-forming propensity of hydrocarbon feedstocks. Feedstocks exhibiting high CCR must be processed to reduce CCR before processing in high-temperature equipment—fired furnaces, heat exchangers, etc. CCR can be reduced by conventional solvent deasphalting or vacuum distillation. Both of these processes result in a small slipstream high in asphaltenes compounds. This stream may be added to the upgraded product depending on product specifications and feedstock quality.

Reference is now made to FIG. 1, which shows a schematic view of the pour point reduction process and system, generally indicated as 100, in accordance with the invention, for converting high-pour-point, low CCR feedstock into an upgraded product. The process and system includes providing an organic, high-pour-point feedstock 102. The crude feedstock 102 may be fed into an equalization tank 104. Generally, an equalization tank acts as a holding tank that allows for the equalization of flow of the feedstock. An equalization tank can also act as a conditioning operation where the temperature of the feedstock is controlled to maintain the proper flow characteristics. The high-pour-point feedstock 106 exits the equalization tank 104 and is fed into pump 108 to form a pressurized feed stream 110 at sufficient pressure to prevent formation of gaseous hydrocarbons during subsequent heating. The pressurized feed stream 110 can be heated by a heating device, such as a heat exchanger 112 to form a heated feed stream 114 that may be further heated by a feed-effluent heat exchanger 116 to form a further heated feed stream 118. It can be appreciated that the pressurized feed stream 110 and heated feed stream 114 can be heated by any known process or device and may include exchange with other process streams to optimize overall thermal efficiency.

The further heated feed stream 118 of the high-pour-point feedstock is then fed through a pressure control valve or depressurizing device 120 to form a heated depressurized stream 122 which is then fed into a separation system. For purposes of the present disclosure, the separation system will be referred to as a rectification or rectifying column, and will be designated by reference numerals 124, 224, 324, and/or 424 throughout the specification and drawings. However, it can be appreciated that the separation system can comprise at least one of one or more flash drums, one or more rectification columns, one or more distillation columns, or any combination thereof. Additionally, the separation system of the present disclosure is operated at a net positive pressure of 2 psig to 30 psig.

With continuing reference to FIG. 1, the rectification column 124 produces a distillate fraction 170 and a heavy fraction 126. The distillate fraction 170 is cooled and condensed in condenser 172 to form a condensed, cooled distillate product 174. The distillate product 174 is fed into one or more separators. The cooled distillate product 174 is separated in a gas-liquid separator (GLS) 176 into a fuel gas 178 and an oil-water stream 180 which is fed into an oil-water separator 182. The oil-water separator 182 produces a process water stream 190, a distillate reflux 184, and a distillate product 186. The conditions of the rectification column are controlled to produce a distillate product that, when blended with the bottoms fraction 162 from flash drum 160 (described below), results in an upgraded product that meets required pour point and flow characteristics. Process water stream 190 may be recycled to a water feed equalization tank 192. Water feed 194 exiting the equalization tank 192 and is fed into pump 196 where it is pressurized to form a high-pressure water stream 198. The heavy fraction or bottoms product 126 from the rectifying column 124 is pressurized by pump 136 to form a pressurized stream 138 and combined with the high-pressure water stream 198 to form a heavy fraction and water pressurized feed stream 140. While conventional mixing devices, such as mixing valves and static mixing elements may be employed, oil and water phases are completely miscible at process operating conditions. The heavy fraction and water pressurized feed stream 140 may be further heated by heat exchanger 142 to form a heated feed stream that is fed into the high-rate hydrothermal reactor system (or high-rate reactor) 146.

One example of a high-rate hydrothermal reactor 146 that can be used is the high-rate reactor disclosed in application U.S. Ser. No. 14/060,225, the disclosure of which is incorporated herein in its entirety. The high-rate reactor 146 is designed to improve reactor fluid dynamics and achieve higher operating temperatures such as operating temperatures between 400 and 700° C. (752° F. and 1292° F.), or between 400° C. and 600° C. (752° F. and 1112° F.) or even between 450° C. and 550° C. (842° F. and 1022° F.). Because the high-rate reactor 146 operates at temperatures much higher than the prior art systems, the reaction rate is greatly increased and the residence time and reactor size are reduced. However, as the reaction temperature is increased, the potential for coke formation and gasification also increases. The high-rate reactor 146 mitigates the effects of high-temperature operation by employing a combination of features. One of these features includes management of water concentration to mitigate coke formation. The high-rate reactor 146 utilizes water-to-organic volume ratios between 1:100 and 1:1, such as between 1:10 and 1:1, and in the present invention, the water-to-oil weight ratio is between 1:20 and 1:1, such as between 1:10 and 1:2. The high-rate reactor typically uses rapid heating of the contents to reach the reaction temperature (such as heating rates of 10° C. to 50° C. (50° F. to 122° F.) per minute) and high pressure to mitigate excessive cracking and gas formation, (such as reaction pressure in the range of 1500-6000 psig, such as in the range of 2000 psig to 3500 psig or in the range of 3000 psig and 4000 psig). The high-rate reactor 146 also utilizes the feature of turbulent flow to optimize mixing, maximize heat transfer, minimize reactor fouling, and suspend solids that form or precipitate. Yet another feature includes the use of a short residence time to minimize secondary cracking and coke formation. Superficial residence times from 1 to 120 seconds may be employed or even less than 1 minute. Rapid quenching may be employed to minimize secondary cracking, coke formation, undesirable secondary reactions, and corrosion. The quench can be accomplished by the addition of water or, in the present invention, quench can be accomplished by the addition of a high-pour-point feedstock.

The high-rate reactor 146 operates at a temperature which increases cracking, isomerization, reforming, dehydrocyclization, and dealkylation rates and achieve a very short residence time, but at a temperature much lower than utilized in conventional steam cracking reactors. By operating at lower temperatures than conventional steam cracking reactors, the present invention minimizes gas and coke formation. It can be appreciated that optimal conversion conditions are dependent on feedstock quality and operating conditions can be varied to achieve the desired product yield and chemistry. For example, when processing high-molecular-weight feedstocks, operating conditions can be varied to maximize the yield of diesel, kerosene, or naphtha, or to control the degree of cyclization and aromatization.

The high-rate reactor 146 can be a tubular reactor, with the inside diameter of the tube or tubes designed to maintain a turbulent flow of the mixture throughout a reaction zone. Turbulent flow occurs at a high Reynolds Number, i.e., the measure of the ratio of inertial force to viscous forces, and is dominated by inertial forces, which tend to produce chaotic eddies, vortices, and other flow instabilities. A high Reynolds Number results in a high heat transfer rate, intimate mixing, and reduces the rate of reactor fouling. A combination of a short residence time and a high Reynolds Number (Re) within the range of 2000-100,000 or even higher than 100,000 throughout the reaction zone can be used to achieve optimal results.

In the high-rate hydrothermal reactor system 146, high molecular weight paraffin molecules are hydrothermally cracked into smaller molecules that exhibit lower pour point and lower viscosity. The upgraded heavy product or reactor effluent 148 is fed through a pressure control valve 150 where it forms a depressurized reactor effluent 152. The depressurized reactor effluent 152 passes through a filter system 154 that may consist of conventional filtration systems, or simply a knockout drum. A filtered reactor effluent 156 may be partially cooled in heat exchanger 116 to produce a partially-cooled reactor effluent stream 158. Reactor effluent stream 158 is then fed into a flash drum 160 where a vapor portion 168 of the reactor effluent 158 is fed to the rectifying column 124 and the liquid bottoms portion 162 of the reactor effluent 158 is cooled by heat exchanger 164 to form cooled reactor effluent 166 which is then combined with distillate product 186 to form an upgraded product 188. According to one embodiment, the high-rate hydrothermal reactor system 146 is capable of transferring a predetermined amount of energy to the heavy product 144 (such as heat and pressure) such that when the upgraded heavy product or reactor effluent 148 is fed into the separation system 124, the predetermined amount of energy (i.e., the reactor effluent 148 is supplied at this predetermined temperature and pressure) is sufficient to effect or to supply enough energy to the rectification column 124 to cause separation of the distillate fraction 170 and the heavy fraction 126. It can be appreciated that the proportion of reactor effluent vapor 168 and liquid bottoms 162 can be controlled by controlling the amount of heat removed by heat exchanger 116. It can also be appreciated that the liquid bottoms portion 162 provides a slipstream to remove heavy refractory compounds from the reactor effluent stream 158 and that the volume and properties of bottoms 162 can be controlled to meet upgraded product specifications.

Reference is now made to FIG. 2, which shows a schematic view of the high-pour-point crude conversion process and system, generally indicated as 200, for converting the high CCR feedstock 202 into an upgraded product, which is configured to address feedstocks that exhibit high levels of CCR caused by constituents, such as asphaltenes or resins. The heavy fraction 226 from the rectifying column 224 is fed to a deasphalting system 230 to produce heavy fraction 234 that exhibits reduced concentrations of asphaltenes and resins. The deasphalting system 230 may be comprised of conventional solvent deasphalting systems or vacuum distillation. Both of these processes result in a small slipstream 232 that contains high levels of asphaltenes. Slipstream 232 may be produced as a separate byproduct that can be used as an asphalt blending component or a coker feedstock. Alternatively, slipstream 232 may be added to the upgraded product (not shown), as long as product specifications can be met.

With continuing reference to FIG. 2, the process and system 200 includes providing the high CCR feedstock 202 into an equalization tank 204. The high pour point feedstock 206 exits the equalization tank 204 and is then fed into pump 208 to form a pressurized feed stream 210 at sufficient pressure to prevent formation of gaseous hydrocarbons during subsequent heating. The pressurized feed stream 210 can be heated by a heating device, such as a heat exchanger 212 to form a heated feed stream 214 that may be further heated by a feed-effluent heat exchanger 216 to form a further heated feed stream 218. As stated above, it can be appreciated that the pressurized feed stream 210 and heated feed stream 214 can be heated by any known process or device and may include exchange with other process streams to optimize overall thermal efficiency.

The further heated feed stream 218 of the high-pour-point feedstock is then fed through a pressure control valve or depressurizing device 220 to form a heated depressurized stream 222 which is then fed into the rectification or rectifying column 224. The rectification column 224 produces a distillate fraction 270 and a heavy fraction 226. As discussed above, the heavy fraction 226 is fed to the deasphalting system 230 to produce the heavy fraction 234 that exhibits reduced concentrations of asphaltenes and resins. The distillate fraction 270 is cooled and condensed in condenser 272 to form a condensed cooled distillate product 274. The cooled distillate product 274 is fed into a gas-liquid separator (GLS) 276 wherein it is separated into a fuel gas 278 and an oil/water stream 280, which is fed into an oil/water separator 282. The oil/water separator 282 produces a process water stream 290, a distillate reflux 284, and a distillate product 286. The conditions of the rectification column 224 are controlled to produce a distillate product that, when blended with the bottoms fraction 262 from flash drum 260, results in an upgraded product that meets required pour point and flow characteristics. Process water stream 290 may be recycled to a water feed equalization tank 292. Water feed 294 exits the equalization tank 292 and is fed into pump 296 where it is pressurized to form a high-pressure water stream 298. The heavy fraction 234 from the deasphalting system 230 is pressurized by pump 236 to form a pressurized stream 238 and combined with the high-pressure water stream 298 to form a heavy fraction and water pressurized feed stream 240. The pressurized feed stream may be further heated by heat exchanger 242 to form a heated feed stream 244 that is fed into the high-rate hydrothermal reactor system 246.

As previously discussed, in the high-rate hydrothermal reactor system 246, high molecular weight paraffin molecules are hydrothermally cracked into smaller molecules that exhibit lower pour point and lower viscosity. The reactor effluent 248 is fed through a pressure control valve 250 where it forms a depressurized reactor effluent 252. The depressurized reactor effluent 252 passes through a filter system 254 that may consist of conventional filtration systems, or simply a knockout drum to form a filtered reactor effluent 256. The filtered reactor effluent 256 may be partially cooled in heat exchanger 216 to produce a partially-cooled reactor effluent stream 258. Reactor effluent stream 258 is then fed into the flash drum 260 where the vapor portion 268 of the reactor effluent is fed to the rectifying column 224 and the liquid bottoms portion 262 of the reactor effluent 258 is cooled by heat exchanger 264 to form cooled reactor effluent 266 which is then combined with distillate product 286 to form upgraded product.

Reference is now made to FIG. 3, which shows a schematic view of the pour point reduction process and system, generally indicated as 300, in accordance with the invention for converting the high-pour-point, low CCR feedstocks into an upgraded product. The low CCR virgin feedstock 302 is fed into an equalization tank 304 to form the high-pour-point feedstock 306, which is then fed into pump 308 to form a pressurized feed stream 310, preheated in heat exchanger system 312 to form heated feed stream 314, further heated in heat exchanger 316 to form a further heated feed stream 318, and fed through a pressure control valve 320, yielding feedstock stream 322 which is fed into the rectifying column 324. Feedstock stream 322 is split into a distillate fraction 370 and heavy fraction 326. Distillate fraction 370 is fed through heat exchanger 372 to form stream 374, which is subsequently fed through a condenser or accumulator 376 to form fuel gas 378. A first portion or reflux stream 380 from the fuel gas 378 is then fed back into rectifying column 324 to increase the separation of the phases therein and a second portion or distillate fraction 382 is combined with the reactor effluent 386 to form the upgraded product 388. The heavy fraction 326 is pressurized by pump 336 to form a pressurized feed 338 which is combined with a high-pressure water feed stream 398 to form a heavy fraction and water pressurized feed stream 340. The heavy fraction and water pressurized feed stream 340 may be further heated by heat exchanger 342 to form a heated feed stream 344 that is fed into the high-rate hydrothermal reactor system 346.

A reactor effluent 348 is fed through a pressure control valve 350 where it forms a depressurized reactor effluent 352. The depressurized reactor effluent 352 passes through a filter system 354 that may consist of conventional filtration systems, or simply a knockout drum. The filtered reactor effluent 356 may be cooled in heat exchanger 316 to produce a partially-cooled reactor effluent stream 358 that may be further cooled by heat exchanger 360. It can be appreciated that sufficient heat is available in reactor effluent stream 356 to provide energy for rectification column 324 operation. It can also be appreciated that heat recovery may include exchange with other process streams to optimize overall thermal efficiency.

Cooled reactor effluent 362 is fed to gas liquid separator 364 to separate a fuel gas 366 from a liquid fraction 368 which is then fed to an oil-water separator 383 to separate water 390 from reactor effluent 386. Processed water 390 may be recycled to the water equalization tank 392. A water feed 394 exits the equalization tank 392 and is fed into pump 396 to form the high pressure water feed stream 398. Reactor effluent 386, which is the upgraded bottoms fraction, is combined with the distillate fraction 382 to form the upgraded product 388.

Reference is now made to FIG. 4, which shows a schematic view of the high-pour-point crude conversion process and system, generally indicated as 400, in accordance with the invention for converting the high CCR feedstock 402 into an upgraded product, configured to address feedstocks that exhibit high levels of CCR caused by constituents, such as asphaltenes or resins. The heavy fraction 426 from the rectifying column 424 is fed to a deasphalting system 430 to produce a heavy fraction 434 that exhibits reduced concentrations of asphaltenes and resins. The deasphalting system 430 may be comprised of conventional solvent deasphalting systems or vacuum distillation. Both of these processes result in a small slipstream 432 that contains high levels of asphaltenes. Slipstream 432 may be produced as a separate byproduct that can be used as an asphalt blending component or a coker feedstock. Alternatively, slipstream 432 may be added to the upgraded product 488, as long as product specifications can be met.

With continuing reference to FIG. 4, the process and system 400 includes providing a high CCR feedstock 402 into an equalization tank 404. The high-pour-point feedstock 406 exits equalization tank 404 and is then fed into pump 408 to form a pressurized feed stream 410 at sufficient pressure to prevent formation of gaseous hydrocarbons during subsequent heating. The pressurized feed stream 410 can be heated by a heating device, such as a heat exchanger 412 to form a heated feed stream 414 that may be further heated by a feed-effluent heat exchanger 416 to form a further heated feed stream 418. As stated above, it can be appreciated that the pressurized feed stream 410 and heated feed stream 414 can be heated by any known process or device and may include exchange with other process streams to optimize overall thermal efficiency.

The further heated feed stream 418 of the high-pour-point feedstock is then fed through a pressure control valve or depressurizing device 420 to form a heated depressurized stream 422 which is then fed into the rectification column 424. The rectification column 424 produces a distillate fraction 470 and a heavy fraction 426. As discussed above, the heavy fraction 426 is fed to the deasphalting system 430 to produce the heavy fraction 434 that exhibits reduced concentrations of asphaltenes and resins. Similar to system 200 shown in FIG. 2, the deasphalting system 430 may be comprised of conventional solvent deasphalting systems or vacuum distillation and both of these processes result in a small slipstream 432 that contains high levels of asphaltenes. Slipstream 432 may be produced as a separate byproduct that can be used as an asphalt blending component or a coker feedstock. Alternatively, the slipstream 432 may be added to the upgraded product 488, as long as product specifications can be met.

A distillate fraction 470 is cooled and condensed in condenser 472 to form a condensed cooled distillate product 474. The cooled distillate product 474 enters into a condenser or accumulator 476 to form fuel gas 478. A first portion or reflux stream 480 from the fuel gas 478 is then fed back into rectifying column 424 to increase the separation of the phases therein and a second portion or distillate fraction 482 is combined with the reactor effluent 486, as discussed in more detail below, to form the upgraded product 488.

The heavy fraction 434 from the deasphalting system 430 is pressurized by pump 436 to form a pressurized stream 438 and combined with a high pressure water stream 498 to form a heavy fraction and water pressurized feed stream 440. The pressurized feed stream may be further heated by heat exchanger 442 to form a heated feed stream 444 that is fed into the high-rate hydrothermal reactor system 446.

A reactor effluent 448 is fed through a pressure control valve or depressurization device 450 where it forms a depressurized reactor effluent 452. The depressurized reactor effluent 452 passes through a filter system 454 that may consist of conventional filtration systems, or simply a knockout drum to form a filtered reactor effluent 456. The filtered reactor effluent 456 may be partially cooled in heat exchanger 416 to produce a partially-cooled reactor effluent stream 458. Reactor effluent stream 458 is then fed into a heat exchanger 460 where it is further cooled. Cooled reactor effluent 462 is fed to a gas liquid separator 464 to separate fuel gas 466 from the liquid fraction 468 which is then fed to an oil-water separator 483 to separate water 490 from reactor effluent 486. Process water 490 may be recycled to the water equalization tank 492. A water feed 494 exits the equalization tank 492 and is fed into pump 496 to form the high-pressure water feed stream 498 which is combined with a pressurized stream 438 of the heavy fraction 434 from the deasphalting system 430. Reactor effluent 486, which is the upgraded bottoms fraction, is combined with the distillate fraction 482 to form the upgraded product 488.

EXAMPLES

Example 1—Pour Point Reduction of Yellow Wax Crude Oil

Yellow wax crude oil from the Uinta Basin in Utah was the feedstock for a pilot demonstration of the pour point reduction process according to the system depicted in FIG. 3. The yellow wax feedstock exhibited low CCR, a pour point of approximately 43° C. (109° F.), and a specific gravity of 0.815 (API gravity=42.1). Table 1 provides the approximate composition of the feedstock by boiling points. The fraction that distilled below 343° C. (650° F.) was approximately 40% of crude feed and represented the low-pour-point, distillate fraction that did not require pour point reduction. The fraction that boiled above 343° C. was approximately 60% of this crude and represented the heavy fraction that required pour point reduction via conversion in the high-rate hydrothermal reactor system.

TABLE 1

Composition of Yellow Wax Feedstock

| Fraction | Temperature Range, ° C. (° F.) | Volume % |
|---|---|---|
| Light naphtha | IBP*-74 (IBP-165) | 1.8 |
| Heavy naphtha | 74-140 (165-284) | 6.8 |
| Kerosene/Diesel | 140-343 (284-650) | 31.9 |
| Vacuum gas oil (VGO) | >343 (650) | 59.5 |
| Below 343° C. (650° F.) | | 40.5 |
| Above 343° C. (650° F.) | | 59.5 |

*IBP = initial boiling point

For this example, a continuous-flow pilot system was configured, as shown in FIG. 3. In this configuration, the feedstock (stream 322) was fractionated into distillate (370) and heavy (326) fractions and the heavy fraction fed to the high-rate hydrothermal reactor system (346). The cooled distillate fraction (382) and cooled, upgraded heavy fraction (386) were then recombined to form the upgraded product (388). The nominal processing capacity of the pilot system was approximately 5 bbl/day. The distillation column for this process was a partially packed, 6-inch diameter by 8-ft column operated with reflux to improve separation of the distillate and heavy fractions. This column effectively separated the two fractions in accordance with the simulated distillation data shown in Table 2, performed on a gas chromatograph indicating the temperature at which each fraction distilled. The data in Table 2 demonstrates that the distillate fraction primarily contained light products (boiling at 343° C. and below) while the heavy fraction primarily contained heavy products (boiling at 324° C. and above).

TABLE 2

Simulated Distillation Results for Distillate and Heavy Fractions

| Wt % Distilled | Distillate Fraction (° C.) | Heavy Fraction (° C.) |
|---|---|---|
| IBP: 0.5% | 19 | 142 |
| 5.0% | 64 | 281 |
| 10.0% | 95 | 324 |
| 20.0% | 124 | 367 |
| 30.0% | 166 | 390 |
| 40.0% | 195 | 410 |
| 50.0% | 234 | 424 |
| 60.0% | 258 | 441 |
| 70.0% | 286 | 463 |
| 80.0% | 315 | 495 |
| 90.0% | 343 | 539 |
| 95.0% | 367 | 574 |
| FBP**: 99.5% | 400 | 626 |

**FBP = final boiling point

A summary of process stream flow rates and system operating conditions is provided in Table 3. In this example, the actual heavy fraction was approximately 60% (vol) of the feed. The volume ratio of water to oil in the combined feed (344) was 0.31. The equivalent weight ratio of water to oil was 0.375.

TABLE 3

Summary of Operating Conditions

| Process Parameter | Operating Condition |
|---|---|
| Yellow wax feed (302), ml/min | 540 |
| Distillate fraction (382), ml/min | 215 |

TABLE 3-continued

Summary of Operating Conditions

| Process Parameter | Operating Condition |
|---|---|
| Heavy fraction (326), ml/min | 325 |
| Process water (398), ml/min | 100 |
| Oil-water reactor feed (344), ml/min | 425 |
| Reactor residence time at operating conditions, sec | 20 |
| Average reactor temperature, ° C. | 515-525 |
| Average reactor pressure, psig | 3200-3500 |
| Fuels gas production (366), std. $ft^3$ per bbl (SCFB) | 200 |

Table 4 provides a summary comparing the properties of the yellow wax feed and upgraded product.

TABLE 4

Properties of Feedstock and Upgraded Product

| Property | Yellow Wax Feedstock | Upgraded product |
|---|---|---|
| Light naphtha, IBP-74° C., % vol | 1.8 | 12.9 |
| Heavy naphtha, 74-140° C., % vol | 6.8 | 19.8 |
| Kerosene/Diesel, 140-343° C., % vol | 31.9 | 57.3 |
| Vacuum gas oil (VGO), >343° C., % vol | 59.5 | 10 |
| Fraction <343° C., % vol | 40.5 | 90.0 |
| Fraction >343° C., % vol | 59.5 | 10.0 |
| Pour point, ° C. | 43 | <0 |
| Specific gravity | 0.815 | 0.77 |

The VGO fraction of the yellow wax feed was reduced from approximately 60% to only 10% in the upgraded product. The kerosene/diesel fraction was increased from approximately 32% in the yellow wax feed to approximately 57% in the upgraded product. Most importantly, pour point of the yellow wax feed was reduced from approximately 43° C. to less than 0° C. It can be appreciated that, for any given feedstock, the proportion of distillate and heavy fractions and the operating conditions of the high-rate hydrothermal reactor may be manipulated to produce an upgraded product that exhibits any desired pour point.

In addition, pour point reduction may be accomplished with limited yield loss. In Example 1, liquid product yield loss due to the production of fuels gas (200 SCFB) equated to approximately 7% by weight of the feedstock. However, since the specific gravity of the feedstock was 0.815 and the specific gravity of the product was 0.77, the actual yield was approximately 98.4% by volume.

Example 2—Pour Point Reduction of Yellow Wax Crude Oil

Yellow wax crude oil from the Uinta Basin in Utah was the feedstock for a pilot demonstration of the pour point reduction process according to the system depicted in FIG. 1. The yellow wax feedstock exhibited low Conradson Carbon Residue (CCR), a pour point of approximately 40° C. (104° F.), and a specific gravity of 0.782 (API gravity=49.4). Table 5 provides the approximate composition of the feedstock by boiling point. The fraction that distilled below 343° C. (650° F.) was approximately 44.8% of crude feed and represented the low-pour-point, distillate fraction that did not require pour point reduction. The fraction that boiled above 343° C. (650° F.) was approximately 55.2% of this crude and represented the heavy fraction that did require pour point reduction via conversion in the high-rate hydrothermal reactor system.

TABLE 5

Composition of Yellow Wax Feedstock

| Fraction | Temperature Range, ° C. (° F.) | Volume % |
|---|---|---|
| Light naphtha | IBP-66 (IBP-150) | 2.1 |
| Heavy naphtha | 66-140 (150-285) | 10.5 |
| Kerosene/Diesel | 140-343 (285-650) | 32.2 |
| Vacuum gas oil (VGO) | >343 (650) | 55.2 |
| Below 343° C. (650° F.) | | 44.8 |
| Above 343° C. (650° F.) | | 55.2 |

A continuous-flow pilot system was configured, as shown in FIG. 1. In this configuration, the feedstock (stream 122) was co-fed with upgraded heavy fraction (168) into the rectification column (124) to produce a distillate fraction (170) and heavy fraction (126). The distillate fraction was cooled, condensed, and fuel gas and water separated to produce the primary distillate product (186). The distillate product represents the distillate fraction of the feedstock and the distillate fraction from the upgraded bottoms product. The heavy fraction (126) was comprised of the heavy fraction of the feedstock and the heavy fraction from unconverted bottoms product. Part of the heavy fraction from the high-rate reactor was produced as a slipstream (162). The bottoms fraction was then mixed with water and fed into the high-rate hydrothermal reactor system (146). The rectification column (124) for this process was a partially packed, 6-inch diameter by 8-ft column operated with reflux to improve separation of the distillate and heavy fractions.

A summary of process stream flow rates and system operating conditions for Example 2 is provided in Table 6. The volume ratio of water to oil in the combined feed (144) was 0.4. The equivalent weight ratio of water to oil was 0.5.

TABLE 6

Summary of Operating Conditions

| Process Parameter | Operating Condition |
|---|---|
| Yellow wax feed (110), ml/min | 120 |
| Distillate fraction (186), ml/min | 50 |
| Heavy fraction (126), ml/min | 190 |
| Process water (198), ml/min | 76 |
| Oil-water reactor feed (140), ml/min | 166 |
| Hydrothermal reactor slipstream (166) | 55 |
| Reactor residence time at operating conditions, sec | 25 |
| Average reactor temperature, ° C. | 515-525 |
| Average reactor pressure, psig | 3200-3500 |
| Fuels gas production (366), std. $ft^3$ per bbl (SCFB) | 200 |

Table 7 provides a summary comparing the properties of the yellow wax feed and upgraded product. The VGO fraction of the yellow wax feed was reduced from 55.2% to only 24.2% in the upgraded product. The kerosene/diesel fraction was increased from 32.2% in the yellow wax feed to 51.2% in the upgraded product. Most importantly, pour point of the yellow wax feed was reduced from approximately 40° C. to less than −12° C. It can be appreciated that, for any given feedstock, the proportion of distillate and heavy fractions and the operating conditions of the high-rate hydrothermal reactor may be manipulated to produce an upgraded product that exhibits any desired pour point.

TABLE 7

Properties of Feedstock and Upgraded Product

| Property | Yellow Wax Feedstock | Upgraded product |
|---|---|---|
| Light naphtha, IBP-66° C. | 2.1 | 6.5 |
| Heavy naphtha, 66-140° C. | 10.5 | 18.1 |
| Kerosene/Diesel, 140-343° C. | 32.2 | 51.2 |
| Vacuum gas oil (VGO), >343° C. | 55.2 | 24.2 |
| Below 343° C. (650° F.) | 44.8 | 75.8 |
| Above 343° C. (650° F.) | 55.2 | 24.2 |
| Pour point, ° C. | 40 | −12 |
| Specific gravity | 0.782 | 0.763 |

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A continuous flow process for converting a high-pour-point organic feedstock to an upgraded product comprising:

providing a high-pour-point organic feedstock;

feeding the high-pour-point organic feedstock into a separation system to produce a distillate fraction and a bottoms fraction;

feeding the bottoms fraction from the separation system into a hydrothermal reactor system operating at supercritical water conditions and turbulent flow having a Reynolds number of at least 2000 to produce an upgraded bottoms fraction; and feeding at least a portion of the upgraded bottoms fraction back into the separation system used to separate the high-pour point organic feedstock to form the upgraded product.

2. The process of claim 1, wherein the hydrothermal reactor system transfers a predetermined amount of energy to the bottoms fraction to produce the upgraded bottoms fraction such that when the upgraded bottoms fraction is fed into the separation system, the predetermined amount of energy is sufficient to effect separation of the distillate fraction and the bottoms fraction.

3. The process of claim 1, further comprising mixing the bottoms fraction from the separation system with one of a water and water-oil mixture to produce a bottoms fraction mixture and feeding the bottoms fraction mixture into the hydrothermal reactor system.

4. The process of claim 3, further comprising separating water from the distillate fraction or the upgraded bottoms fraction for recovering water for recycling and combining with the bottoms fraction.

5. The process of claim 3, further comprising maintaining a temperature and pressure of the water and bottoms fraction mixture in the hydrothermal reactor system for sufficient time to produce an upgraded bottoms fraction that has a low-pour-point.

6. The process of claim 1, wherein the high-pour-point organic feedstock has a pour point greater than 10° C. and is selected from the group consisting of bottoms crude oil, tar sands bitumen, shale oil, waxy crude oils including yellow wax and black wax, petroleum oil fractions, synthetic crudes, and mixtures thereof.

7. The process of claim 6, wherein the synthetic crudes comprises wax from the Fischer-Tropsch process.

8. The process of claim 1, wherein the separation system is operated at net positive pressure of 2 psig to 30 psig and comprises at least one of one or more flash drums, one or more rectification columns, one or more distillation columns, or any combination thereof.

9. The process of claim 1, further comprising depressurizing the upgraded bottoms fraction exiting from the hydrothermal reactor system, filtering the depressurized upgraded bottoms fraction, partially cooling the filtered depressurized bottoms fraction in a feed-effluent heat exchanger, and feeding the partially cooled bottoms fraction to a flash drum where a bottoms portion that contains refractory compounds is combined with the distillate fraction from the separation system to form the upgraded product.

10. The process of claim 1, further comprising providing one or more condensers to condense the distillate fraction from the separation system to produce fuel gas and a reflux stream, wherein a first portion of the reflux stream is fed into the separation system.

11. The process of claim 10, wherein a second portion of the reflux stream is combined with a portion of the upgraded bottoms fraction from the hydrothermal reactor to produce the upgraded product.

12. The process of claim 11, wherein no byproducts or organic waste products are produced.

13. The process of claim 1, further comprising treating the bottoms fraction from the separation system in a deasphalting process to remove coke precursors from feedstocks exhibiting high Conradson Carbon Residue (CCR) before the bottoms fraction is fed to the hydrothermal reactor system.

14. The process of claim 13, wherein the deasphalting process comprises one of a solvent deasphalting process and vacuum distillation.

15. The process of claim 3, wherein the water-to-oil weight ratio in the high-rate hydrothermal reactor system is between 1:20 and 1:1.

16. The process of claim 15, wherein the water-to-oil weight ratio is between 1:10 and 1:2.

17. The process of claim 3, wherein the bottoms fraction and oil-water mixture is heated in the hydrothermal reactor system to a temperature between 400° C. and 600° C.

18. The process of claim 17, wherein the bottoms fraction and oil-water mixture is heated to a temperature between 450° C. and 550° C.

19. The process of claim 5, wherein the pressure in the hydrothermal reactor system is maintained at least at 3200 psig.

20. The process of claim 1, wherein the residence time of the bottoms fraction in the hydrothermal reactor system at operating conditions is less than 1 minute.

21. The process of claim 1, including depressurizing the upgraded bottoms fraction exiting the hydrothermal reactor system, filtering the depressurized upgraded bottoms fraction, feeding the filtered upgraded bottoms fraction to a feed-effluent heat exchanger, cooling the filter upgraded bottoms fraction, feeding the cooled upgraded bottoms fraction to one or more separators to remove fuel gas and water therefrom, and combining the upgraded bottoms fraction exiting the one or more separators with the distillate fraction to form the upgraded product without the production of byproducts or organic waste products.

22. The process of claim 21, further comprising treating the bottoms fraction from the separation system in a deasphalting process to remove coke precursors from feedstocks exhibiting high Conradson Carbon Residue (CCR) before the bottoms fraction is fed to the hydrothermal reactor system and wherein the deasphalting process comprises one of a solvent deasphalting process and vacuum distillation.

23. The process of claim 1, further comprising combining at least a portion of the upgraded bottoms fraction with the distillate fraction to form the upgraded product.

24. A continuous flow process for converting a high-pour-point organic feedstock to an upgraded product comprising:

providing a high-pour-point organic feedstock;

feeding the high-pour-point organic feedstock into a separation system to produce a distillate fraction and a bottoms fraction;

feeding the bottoms fraction from the separation system into a hydrothermal reactor system operating at supercritical water conditions and turbulent flow having a Reynolds number of at least 2000 to produce an upgraded bottoms fraction; and feeding at least a portion of the upgraded bottoms fraction into the separation system to form the upgraded product, wherein the hydrothermal reactor system transfers a predetermined amount of energy to the bottoms fraction to produce the upgraded bottoms fraction such that when the upgraded bottoms fraction is fed into the separation system, the predetermined amount of energy supplies all of the energy needed to effect separation of the distillate fraction and the bottoms fraction.

25. The process of claim 1, wherein the method comprises feeding the upgraded bottoms fraction into a flash drum to form a vapor portion and a liquid bottoms portion and the method further comprises controlling a proportion of the vapor portion of the upgraded bottoms fraction and the liquid bottoms portion of the upgraded bottoms fraction by controlling an amount of heat removed from the upgraded bottoms fraction, feeding the vapor portion of the upgraded bottoms fraction into the separation system, and combining the liquid bottoms portion of the upgraded bottoms fraction with the distillate fraction to form the upgraded product, wherein the high-rate hydrothermal reactor system transfers a predetermined amount of energy to the bottoms fraction such that when the vapor portion of the upgraded bottoms fraction is fed into the separation system, the predetermined amount of energy is sufficient to effect separation of the distillate fraction and the bottoms fraction.

* * * * *